US006599045B1

(12) United States Patent
Kolb

(10) Patent No.: US 6,599,045 B1
(45) Date of Patent: Jul. 29, 2003

(54) HEIGHT MEASURING LEVEL PEN/PENCIL

(75) Inventor: Gayle L. Kolb, Kent, WA (US)

(73) Assignee: Gayle Kolb, Kent, WA (US)

( * ) Notice: Subject to any disclaimer, the term of this patent is extended or adjusted under 35 U.S.C. 154(b) by 0 days.

(21) Appl. No.: 10/331,224

(22) Filed: Dec. 30, 2002

(51) Int. Cl.[7] ..... B43K 29/18; B43K 29/00

(52) U.S. Cl. ..... 401/52; 33/18.2; 33/354; 33/389; 33/512; 401/195; D19/36

(58) Field of Search ..... 401/52, 195; 33/18.2, 33/354, 389, 512, 379; D19/36

(56) References Cited

U.S. PATENT DOCUMENTS

D126,555 S * 4/1941 Gurtov ..... D19/36 X
D330,910 S * 11/1992 Warburton ..... D19/36
5,522,146 A * 6/1996 Warburton ..... 33/354 X

* cited by examiner

*Primary Examiner*—Kathleen J. Prunner
(74) *Attorney, Agent, or Firm*—Donald W. Meeker

(57) ABSTRACT

A level pen/pencil or other writing instrument is equipped with an end-mounted level vial which mates with the pen/pencil barrel. The housing of the level is entirely clear allowing for the bubble of the level to be visible from all sides of the pen/pencil. The level pen/pencil is designed with sufficient length for reaching from a center of a child's head to a vertical wall surface for marking the child's height thereon. The level pen/pencil can also be used for other applications requiring both a level and a marking means such as construction, repair work, hanging pictures or shelves, or various other leveling and marking tasks.

13 Claims, 2 Drawing Sheets

HEIGHT MEASURING LEVEL PEN/PENCIL

BACKGROUND OF THE INVENTION

1. Field of the Invention

The present invention relates to writing implements and levels and in particular to a level pen/pencil with an end-mounted level vial mating with the pen/pencil barrel and a level bubble visible from all sides of the pen/pencil and a length sufficient for reaching from a center of a child's head to a vertical wall surface for marking the child's height thereon.

2. Description of the Prior Art

It is a common practice to use a chart attached to a wall or in some cases the wall or vertical portion of a door frame for marking a child's height and keeping a running record of the growth of the child over a period of time. Various linear devices are used, depending on what is at hand, for holding the device on top of the child's head and butting one end of the device against the vertical surface to be marked and trying to look at the device to see if it is level so that the mark on the vertical surface will be accurately placed. Then the parent or other person doing the measuring has to try and make the mark along an edge of the device striving for accuracy in alignment of the marking implement with the edge of the device. These makeshift devices are often not accurate in being held level with the top of the head of the child or in making a mark which is even with the edge of the device. Something as small as a 5 percent angle on a pen thought to be level can distort the child's height measurement up to a half inch.

While there have been a variety of marking devices with built-in levels, none would work well as a means for accurately measuring a child's height and marking the height on a wall surface since they lack a sufficient length to reach the wall from the center of a child's head and often lack a uniformly even surface for accurate placement on the child's head and often provide level bubbles which are not readable from a side view or at various angles.

U.S. Pat. No. D330910, issued on Nov. 10, 1992 to Warburton, shows an ornamental design for a combined twin nibbed marker and level.

U.S. Pat. No. D92705, issued on Jul. 10, 1934 to Deli, illustrates a combined pencil and advertising device which has a level built into the body of the pencil.

U.S. Pat. No. D126555, issued on Apr. 15, 1941 to Gurtov, indicates a combination pencil, ruler, and level device.

U.S. Pat. No. 5,522,146, issued on Jun. 4, 1996 to Warburton, depicts a holder for releasably engaging a level and pencil therein. The holder generally comprises a housing having a first and second open ends configured to releasably fit about a carpenter's pencil. A window is centrally positioned in a wall of the housing and between two longitudinally spaced-apart walls positioned within the housing which form a chamber there between. A port in each wall allows for extension of a bubble level between the end walls through the chamber and adjacent the window.

U.S. Pat. No. 5,190,388, issued on Mar. 2, 1993 to Lee concerns a writing device including a means for observing and measuring the inclination of the device in order to teach proper penmanship to pupils using the device at a young and formidable age. The writing device includes an oil-filled vessel with lines imprinted thereon whereby the imprinted lines of a container match up with the angle of the oil at the optimum inclination at which to hold the writing instrument.

U.S. Pat. No. 2,215,084, issued on Sep. 17, 1940 to Neal, discloses a balanced writing implement that contains a level.

What is needed is a level pen/pencil of sufficient length to reach from the center of a child's head to a wall and with a level vial aligned with the barrel of the pen/pencil and a clearly visible level bubble from all angles.

SUMMARY OF THE INVENTION

An object of the present invention is to provide a level pen/pencil or writing instrument that is easy to use. The level pen/pencil is just rested on head or other surface that needs to be measured or leveled.

Another object of the present invention is to provide a 360 degree viewable level vial that can be seen from any angle, at any axial orientation of the level pen/pencil.

An additional object of the present invention is having a smooth alignment of level vial with pen or other writing implement, so the level pen/pencil rests evenly on head or other surface for accurate alignment of the barrel/level vial and point of the writing implement.

One more object of the present invention is that it can be a pen, pencil, felt-tip marker, or other type of writing instrument.

A further object of the present invention is ease of fabrication, due to having a peg protruding from the end of the level vial which can be inserted in the axial ink tube opening of a ball point pen as a substitute for the normal end cap.

A further object of the present invention is to provide an economical, leveling/marking device.

A contributory object of the present invention is to provide a compact design, allowing the user to place it in a pocket, leaving the user's hands free for work.

An added object of the present invention is to provide a time saving device for the user by combining two implements in one.

An ensuing object of the present invention is to provide accuracy in measuring a child's height.

In brief, a long barreled pen or pencil is further increased in length by mounting or attaching a clear cylindrical level vial to the end of the pen or pencil opposite to the writing end. This is preferably accomplished by having a protruding pin from an end of the level vial insert with a tight friction fit into a centered end opening in the pen or pencil wherein the ink tube or lead is positioned. Alternately or in addition a cement or glue can be used for attaching the level to the end of the pen or pencil.

The level vial is preferably the same diameter as the cylindrical pen or pencil and the outer surface of the level vial aligns with the outer surface of the pen or pencil so that it may be placed flat against the top of the child's head for an accurate measurement.

The level vial is also preferably a clear plastic vial with the level bubble visible on all sides of the level vial so that the person holding the level pen/pencil can simply place the level pen/pencil on the child's head and automatically see the level bubble no matter what the relative height of the measurer and the child.

An advantage of the present invention is that it is easy to use. The level pen/pencil is simply rested on head or other surface that needs to be measured or leveled.

Another advantage of the present invention is that it provides a 360 degree viewable level vial that can be seen from any angle, at any axial orientation of the level pen/pencil.

An additional advantage of the present invention is in having a smooth linear alignment of level vial with pen or other writing implement, so the level pen/pencil rests evenly on head or other surface for accurate linear alignment of the barrel/level vial and point of the writing implement.

One more advantage of the present invention is that it can be manufactured as a pen, pencil, felt-tip marker, or other type of writing instrument.

A further advantage of the present invention is that it is easy to fabrication, due to having a peg protruding from the end of the level vial which can be inserted in the axial ink tube opening of a ball point pen as a substitute for the normal end cap.

A further advantage of the present invention is in being an economical leveling/marking device.

Yet another advantage of the present invention is a compact design, allowing the user to place it in a pocket, leaving the user's hands free for work.

Still another advantage of the present invention is in providing a time saving device for the user by combining two implements in one.

A further advantage of the present invention is that it provides accuracy in measuring a child's height.

BRIEF DESCRIPTION OF THE DRAWINGS

These and other details of my invention will be described in connection with the accompanying drawings, which are furnished only by way of illustration and not in limitation of the invention, and in which drawings.

BEST MODE FOR CARRYING OUT THE INVENTION

In FIGS. 1–4, a level marking implement device 20 and 20A with one end having a level 21 and 21A for resting on top of a child's head makes a horizontally aligned mark 31 on a vertical surface 30 indicating the height of the child.

Figure 4:
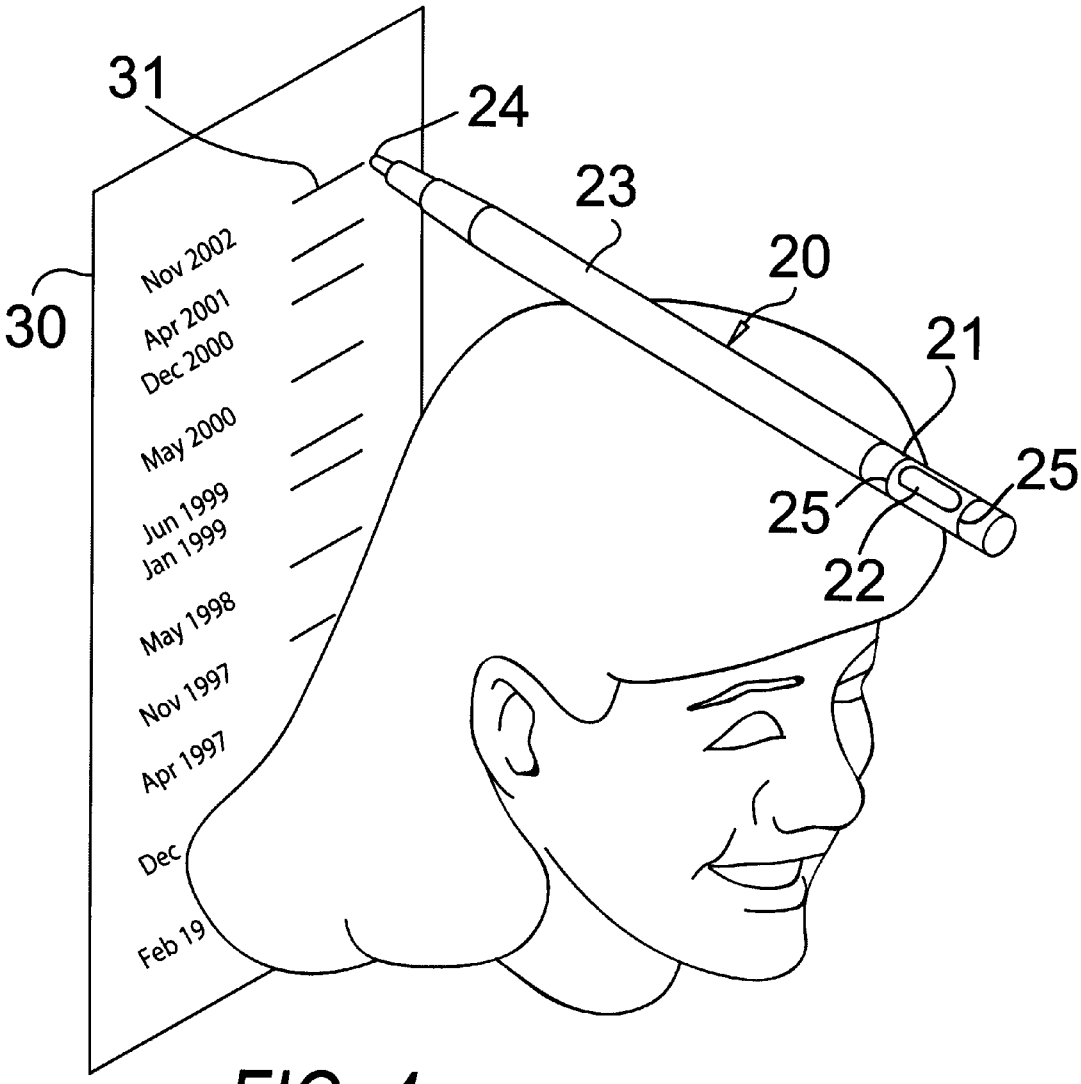
FIG. 4 is a perspective view of the level pen of FIG. 1 in use positioned on the top of a child's head with the pen point in contact with a wall chart for marking the height of the child on the wall chart.

A marking means comprises an elongated shaft 23 and 23A having a marking end with a means, such as a pen tip 24, pencil tip 24A or other writing tip, for making a visible mark 31 on an exterior vertical surface 30, as seen in FIG. 4, and a level attaching end with an opening 29 opposite to the marking end.

A level means comprises preferably a level vial 21 with an elongated housing having an exterior surface with a mating configuration to the elongated shaft 23 of the marking means. Preferably, the level has a mating diameter cylindrical housing that aligns axially with the cylindrical elongated shaft of the marking means 23 with a smooth linear alignment to allow the level pen/pencil to rest evenly on a child's head. The level means comprises a level vial 21 having a clear housing around the entire exterior surface, a liquid contained therein, a bubble 22 floating in the liquid, and indicia 25. The indicia 25 comprise a pair of visual rings extending around the entire exterior surface of the clear cylindrical housing. The indicia 25 are spaced apart by the distance of the bubble 22, and are used for aligning the bubble 22 within the indicia 25 to determine a horizontal orientation of the level marking implement device 20. The bubble 22 is visible from all orientations of the level vial 21 and the level marking implement device 20 is capable of being positioned and viewed for use at any axial orientation.

The level marking implement device 20 is capable of being aligned horizontally, as indicated by the level means, on an exterior surface, having at least one horizontal surface with at least the level means resting on the horizontal surface and further capable of making a mark 31 with the marking end on a vertical exterior surface 30. The mark 31 on the vertical surface 30 being a distance from the horizontal point and in horizontal alignment with the at least one horizontal point.

The level marking implement device 20 has an overall length greater than the horizontal distance from a center of a human head to a vertical surface 30 in contact with the back of the head so that the level marking implement device 20 is capable of resting on top of the head of the human and marking a height of the human on the vertical surface 30. The level 21 extends the effective overall length of the level marking implement device 20.

Figure 1:
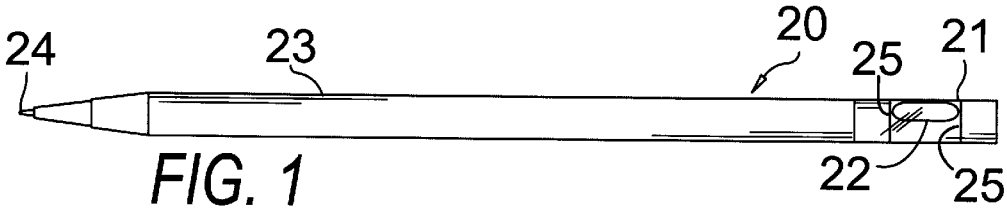
FIG. 1 is a side elevational view of a preferred embodiment of the invention showing a level vial attached to an end of a pen to form an elongated level pen.
Figure 2:
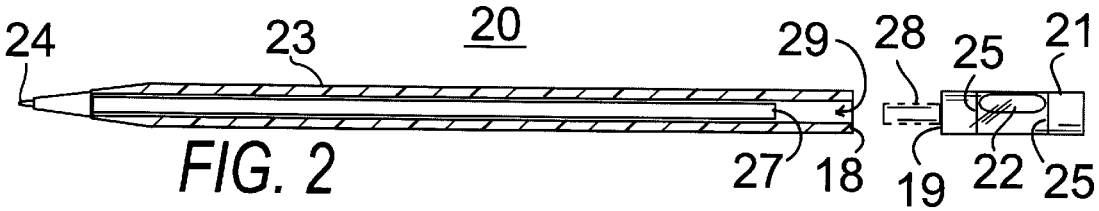
FIG. 2 is a side elevational view in partial cross-section of the preferred embodiment of the invention of FIG. 1 showing a level vial with a protruding pin aligned for attachment to the end of the pen.
Figure 2A:
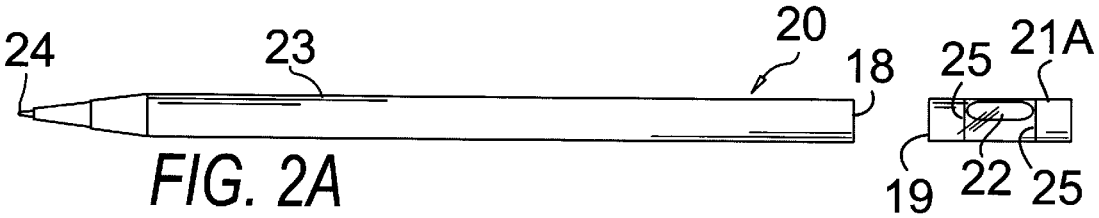
FIG. 2A is a side elevational view of an alternate embodiment of the invention showing a level vial with a flat end aligned for attachment to the flat end of the pen.
Figure 3:
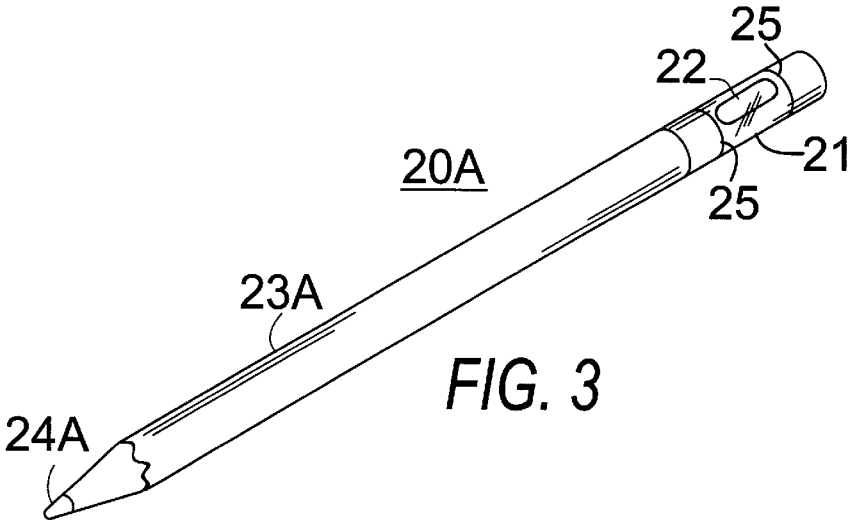
FIG. 3 is a perspective view of an alternate embodiment of the invention showing a level vial attached to an end of a pencil to form an elongated level pencil.

In FIG. 2A, the attaching end of the elongated shaft 23, which is opposite to the marking end, comprises a flat face 18 which mates with the flat end face 19 of the level 21, and can be secured thereto by a bonding means, such as plastic welding for gluing the level on or using a glue or epoxy.

In FIG. 2, the elongated shaft 23 of the level marking device 20 further comprises a central axial opening 29 throughout its length for housing the writing means, such as a ballpoint pen ink tube 27. The central axial opening 29 has an extension portion longer than the tube 27 which leaves room for a peg 28 protruding from the end face 19 of the level. Normally the cap (not shown) for the pen would fit in the opening 29, but in this case, instead the peg 28 is inserted in the axial opening 29 with a tight friction fit to secure the level means to the marking means. A bonding means can be used to further secure the peg 28 in the axial opening 29.

The marking means of the device 20 may comprise a ballpoint pen with the ink tube 27 capable of fitting within the axial opening 29 and the level means replaces an end cap normally positioned in the end 29 of the ballpoint pen. Marking means for the device 20 could comprise a pen tip 24, pencil tip 24A, ink loaded marking point, or other marking means. The marking means is capable of being used on many different materials including plastic laminate, painted wood, paper, cloth fabric and drywall (wall board).

As seen in FIG. 4, in practice a person stands with his/her heels pressed up against a wall, shoulders back and eyes looking straight ahead. The level 21 end of the level marking implement 20 would then be placed on top of the person's head, making small adjustments to the angle of the level pen/pencil 20 until the bubble 22 is directly centered inside the two circular graduation marks (indicia) 25 of the level vial 21. Next, a small mark 31 would be made on the vertical exterior surface 30 with the marking tip 24 of the level marking device 20 at the same height as the person being measured. For extreme accuracy, ¼ inch would be subtracted from the mark 31 to reflect half the distance of the radius of the level marking implement 20.

In practice the level marking device 20 could also be used for construction, repair work, hanging pictures or shelves, or for other leveling tasks. The level marking implement 20 would be rested on the item in need of leveling; the angle of the device 20 would then be adjusted until the bubble 22 was directly centered between the two indicia 25 on the level vial 21, thereby showing the item as being horizontally level.

It is understood that the preceding description is given merely by way of illustration and not in limitation of the invention and that various modifications may be made thereto without departing from the spirit of the invention as claimed.

What is claimed is:

1. A level marking implement device for making a horizontally aligned mark on a vertical surface, the device comprising:

a marking means comprising an elongated shaft having a marking end with a means for making a visible mark on the vertical surface, an attaching end opposite to the marking end and an effective overall length sufficient to reach the vertical surface from the center of a child's head;

a level means comprising an elongated housing having an exterior surface with a uniformly even mating configuration to the elongated shaft of the marking means, the level means mounted to the attaching end of the marking means so that the elongated housing is aligned with the elongated shaft with a smooth linear alignment, the level means extending the effective overall length of the level marking implement device, the level means having a visual means for indicating that the housing of the level means is in a horizontal orientation, so that the level marking implement device is capable of being aligned horizontally, as indicated by the level means, with at least the level marking implement device resting evenly on the center or horizontal surface of the child's head or another horizontal surface to be measured or leveled and further capable of making a mark with the marking end of the marking means on the vertical surface while being disposed at a distance from the horizontal surface but in horizontal alignment with the horizontal surface.

2. The device of claim 1 wherein the level marking implement device has an overall length greater than the horizontal distance from a center of the child's head to the vertical surface being in contact with the back of the head so that the level marking implement device is capable of resting on top of the head while marking a height of the child on the vertical surface.

3. The device of claim 1 wherein the level means comprises a level vial having a clear housing around the entire exterior surface with a liquid contained therein and a bubble floating in the liquid and an indicia extending around the entire exterior surface on the housing for aligning the bubble with the indicia to determine a horizontal orientation of the level vial, so that the bubble is visible from all orientations of the level vial and the level marking implement device is capable of being positioned and viewed for use at any axial orientation of the level marking implement device.

4. The device of claim 3 wherein the marking means has a cylindrical elongated shaft and the level means has a mating diameter cylindrical housing aligned axially with the cylindrical elongated shaft of the marking means.

5. The device of claim 4 wherein the indicia comprises a pair of visual rings around the cylindrical housing spaced apart by the distance of the bubble.

6. The device of claim 1 wherein the means for making a visible mark comprises a pen tip.

7. The device of claim 1 wherein the means for making a visible mark comprises a pencil tip.

8. The device of claim 1 wherein the marking means comprises a writing implement with the attaching end having a flat attaching end face and the level means has a mating flat level housing end face capable of engaging the attaching end face and capable of being secured thereto by a securing means.

9. The device of claim 8 wherein the securing means is a bonding means.

10. The device of claim 8 wherein the elongated shaft of the writing implement further comprises a central axial opening therethrough for housing a writing means and the central axial opening has an extension portion longer than the writing means with the axial opening communicating with the attaching end face and the housing of the level means further comprises a protruding peg from the level housing end face, the peg being capable of insertion in the axial opening with a tight friction fit and further capable of securing the level means to the marking means.

11. The device of claim 10 wherein the writing means comprises a pen with an ink tube capable of fitting within the axial opening and the level means replaces an end cap normally positioned in the attaching end of the pen.

12. The device of claim 10 wherein the securing means comprises a bonding means for securing the peg in the axial opening.

13. The device of claim 1 wherein the marking means has a means for making a mark which is capable of marking on a material selected from the list of materials including plastic laminate, painted wood, cloth fabric and drywall.

* * * * *